US008881560B2

(12) United States Patent
Avganim

(10) Patent No.: US 8,881,560 B2
(45) Date of Patent: Nov. 11, 2014

(54) THEFT-PROTECTING ASSEMBLY FOR RECHARGEABLE HAND-HELD ELECTRONIC DEVICES

(76) Inventor: Meir Avganim, Moshav Gealiya (IL)

( * ) Notice: Subject to any disclaimer, the term of this patent is extended or adjusted under 35 U.S.C. 154(b) by 1024 days.

(21) Appl. No.: 12/933,680

(22) PCT Filed: Mar. 18, 2009

(86) PCT No.: PCT/IL2009/000304

§ 371 (c)(1),
(2), (4) Date: Nov. 30, 2010

(87) PCT Pub. No.: WO2009/116039

PCT Pub. Date: Sep. 24, 2009

(65) Prior Publication Data

US 2011/0080137 A1 Apr. 7, 2011

(30) Foreign Application Priority Data

Mar. 20, 2008 (IL) ..... 190345

(51) Int. Cl.
*E05B 65/00* (2006.01)
*E05B 73/00* (2006.01)

(52) U.S. Cl.
CPC ..... *E05B 73/0082* (2013.01)
USPC ..... 70/57.1; 70/58; 70/158; 70/163

(58) Field of Classification Search
USPC ..... 70/57.1, 58, 63, 158–173
See application file for complete search history.

(56) References Cited

U.S. PATENT DOCUMENTS 6,192,722 B1 * 2/2001 Galant ..... 70/58
6,212,921 B1 * 4/2001 Knighton ..... 70/58
6,581,420 B1 6/2003 Ling et al.
6,711,921 B1 3/2004 Yang
7,299,668 B1 * 11/2007 Lu ..... 70/58
7,499,270 B2 * 3/2009 Allen ..... 361/679.56
8,264,835 B2 * 9/2012 Tang et al. ..... 70/58

(Continued)

FOREIGN PATENT DOCUMENTS

DE 100 51 676 A1 5/2002
GB 2 359 850 A 9/2001
GB 2 362 423 A 11/2001
GB 2 414 348 A 11/2005
WO 2007/044096 A1 4/2007

OTHER PUBLICATIONS

International Search Report for Corresponding International Patent Application No. PCT/IL2009/000304, dated Aug. 3, 2009.

(Continued)

*Primary Examiner* — Christopher Boswell
(74) *Attorney, Agent, or Firm* — Ostrolenk Faber LLP

(57) ABSTRACT

A theft-protecting electronic device (16;116) recharging assembly comprising a block-shaped stand (12; 112) having a cavity (14;122*c*) into and from which the device can be partly inserted and retrieved by a substantially linear sliding movement. A rigid jacket (30;130) embracing the device from at least three sides thereof is provided, one of which being the side opposite the one inserted into said cavity. A lock-receiving porting (30*e*;130*g*) is integrally formed with the jacket. A lockable device (20,120) is associated with the stand, being manipulatable between a locking position wherein it engages the said lock-receiving portion, thereby arresting the electronic device within said cavity, and an unlocked position wherein the electronic device is freely retrievable from said cavity. The stand is adapted to be secured by a cable (40;140) to an immovable object (42,142).

3 Claims, 9 Drawing Sheets

(56) References Cited

U.S. PATENT DOCUMENTS

| | | | | |
|---|---|---|---|---|
| 8,418,514 | B1 * | 4/2013 | Su | 70/58 |
| 8,464,563 | B2 * | 6/2013 | Perez et al. | 70/58 |
| 2003/0161099 | A1 | 8/2003 | Aoki et al. | |
| 2004/0177658 | A1 * | 9/2004 | Mitchell | 70/58 |

OTHER PUBLICATIONS

International Preliminary Report on Patentability for Corresponding International Patent Application No. PCT/IL2009/000304, dated Sep. 21, 2010.

* cited by examiner

THEFT-PROTECTING ASSEMBLY FOR RECHARGEABLE HAND-HELD ELECTRONIC DEVICES

CROSS-REFERENCE TO RELATED APPLICATIONS

The present application claims priority to Israeli Patent Application No. 190345, filed 20 Mar. 2008; and International Patent Application No. PCT/IL2009/000304 filed 18 Mar. 2009, the contents of which are incorporated herein by reference.

STATEMENT REGARDING FEDERALLY SPONSORED RESEARCH OR DEVELOPMENT

Not applicable.

BACKGROUND OF THE INVENTION

Field of the Invention

The present invention generally concerns anti-theft devices. More specifically, the invention relates to an arrangement for protecting hand-held devices such as cell-phones, music players, mini-computers, GPS navigators, etc. (hereinafter collectively referred to as "Electronic Devices"), which need from time to time to be charged.

In many cases, recharging of an electronic device means that it is left unattended, be it in offices, schoolrooms, libraries, restaurants, trains, and other public or semi-public places. Necessarily the recharging process takes place by connecting the device to a wall plug via a transformation unit, i.e. never in a central location where it can be constantly watched.

For all these reasons, valuable electronic devices are being quite frequently "snatched" in a matter of seconds.

OBJECTS OF THE INVENTION

It is thus the prime object of the present invention to cure this aggravating situation.

It is a further object of the present invention to provide a recharging assembly in the form of a stand or cradle adapted to be anchored to an immovable object, associated with lockable means which renders the separation of the electronic device there from difficult and/or time consuming in case of an attempted theft.

It is a still further object of the invention that the said cradle be tailored to the physical size and shape of the more popular electronic devices.

It is a still further object of the present invention to incorporate in the assembly standard, commercially available, recharging cradles.

SUMMARY OF THE INVENTION

According to a general aspect of the invention there is provided a theft protecting electronic devices recharging assembly comprising a block-shaped stand having a cavity into and from which the device can be partly inserted and retrieved by a substantially linear sliding movement. A rigid jacket embracing the device from at least three sides thereof is provided, one of which being the side opposite the one inserted into said cavity. A lock-receiving portion is integrally formed with the jacket. A lockable device is associated with the stand, being manipulatable between a locking position wherein it engages the said lock-receiving portion, thereby arresting the electronic device within said cavity, and an unlocked position wherein the electronic device is freely retrievable from said cavity. The stand is adapted to be secured to an immovable object.

BRIEF DESCRIPTION OF THE DRAWINGS

These and additional constructional features and advantages of the present invention will become more readily understood in the light of the ensuing description of two preferred embodiments thereof, given by way of example only, with reference to the accompanying drawings, wherein—

DETAILED DESCRIPTION OF THE PREFERRED EMBODIMENTS

Referring to FIGS. 1-4, the theft-protecting assembly generally denoted 10 comprises a base in the form of stand or cradle 12 having a cavity 14 sized and shaped to snugly nest therein the bottom part of the electronic device, e.g. iPod 16 as shown in phantom lines (hereinafter referred to as "the protected device").

The cradle 12 is further provided with a prismatic upright portion 18.

Figure 1:
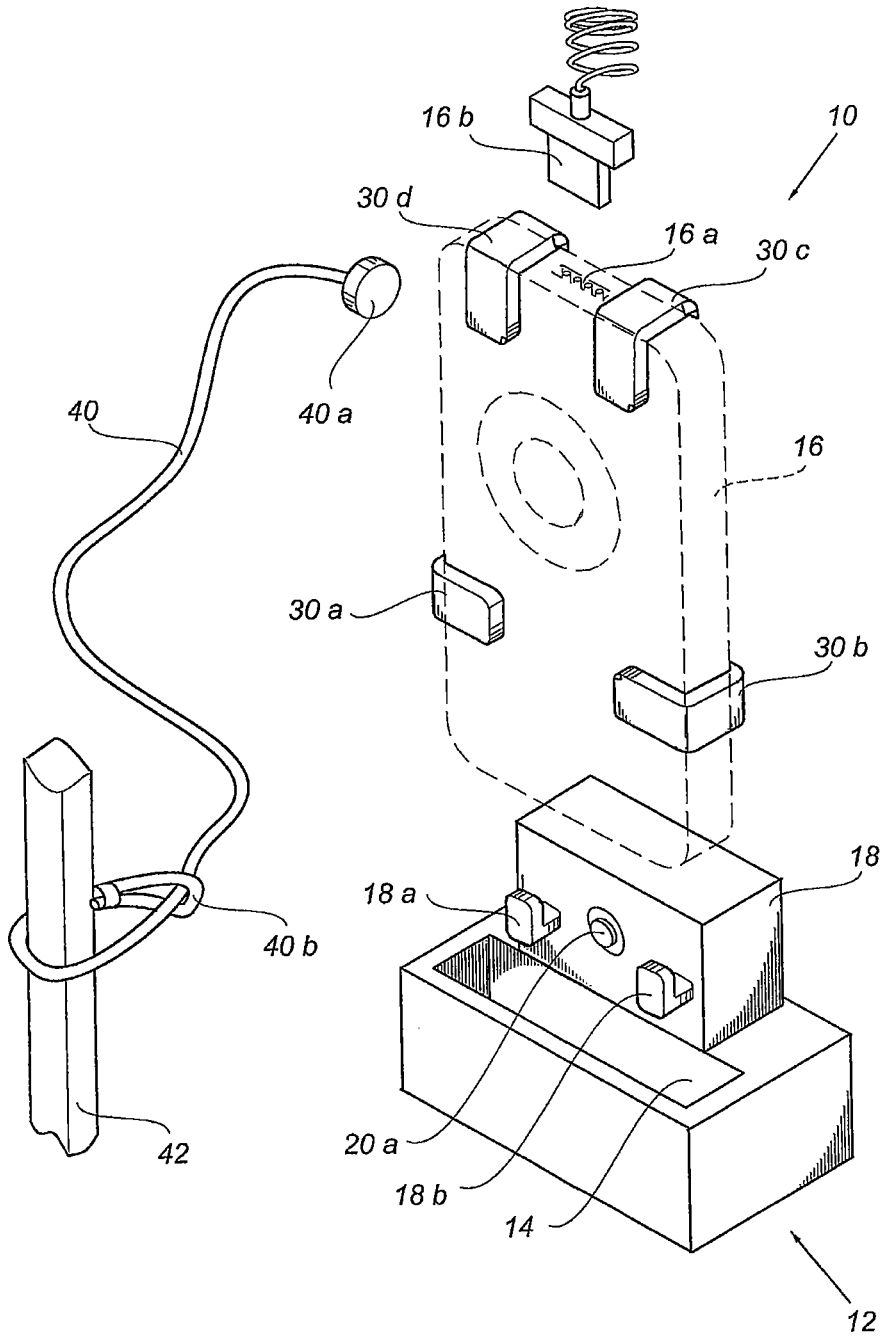
FIG. 1 is a general, schematic front view of a theft protecting assembly according to a first preferred embodiment of the invention.
Figure 2:
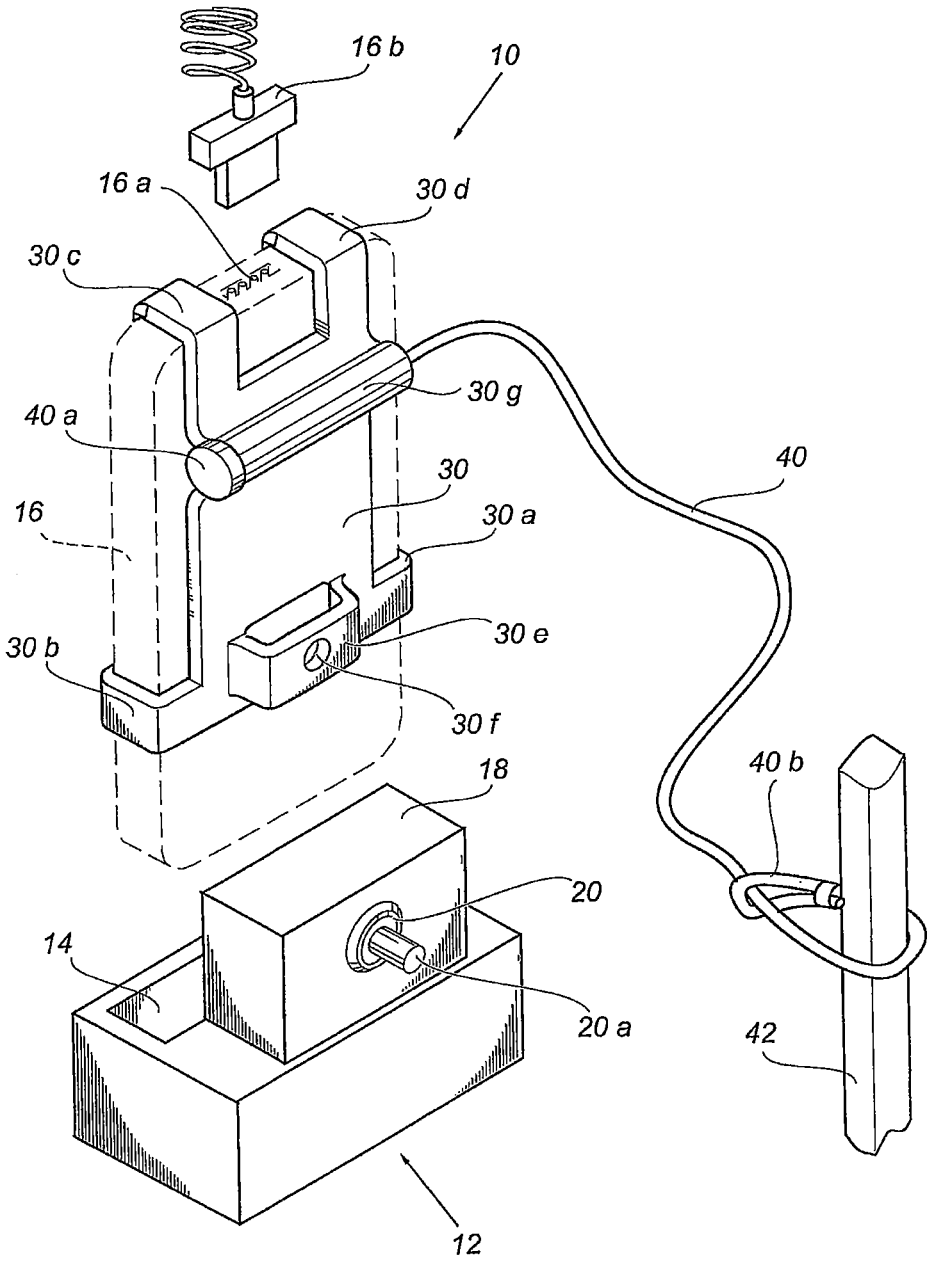
FIG. 2 is a rear view of the assembly of FIG. 1.

A push-button type lock (or any equivalent, key operated locking device) 20 is installed in the portion 18 so that its lock pin 20*a* is manipulatable between a projected, locking position (see FIGS. 3 and 4) and a withdrawn, unlocking position (FIGS. 1 and 2).

First and second hook-like projections 18*a* and 18*b* are provided at the front side of the up-right portion 18, each at one side of the extendible lock pin 20*a*.

The protected device 16 is dressed by a shell or jacket 30, preferably made of sheet metal or rigid plastics. It embraces the protected device 16 from all sides except its bottom. In the example shown, the jacket 30 comprises first and second side brackets 30*a* and 30*b*, and a pair of top brackets 30*c* and 30*d*.

The device 16 is thus slideable into the jacket 30 (or vice-versa).

The standard recharging socket 16*a* of the protected device 16 is accessible by recharging plug 16*b*, as shown.

Integrally formed with the back portion of the jacket 30 (e.g. by stamping if made by metal) is a bulging bridge-portion 30*e* formed with an opening 30*f*.

Figure 3:
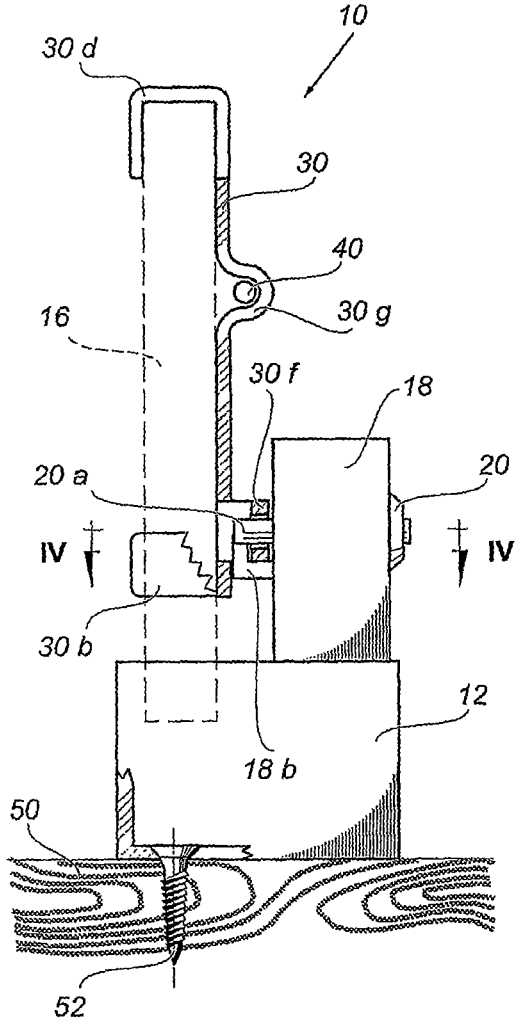
FIG. 3 is a side, partly cross-sectional view of the assembly of FIG. 1.
Figure 4:
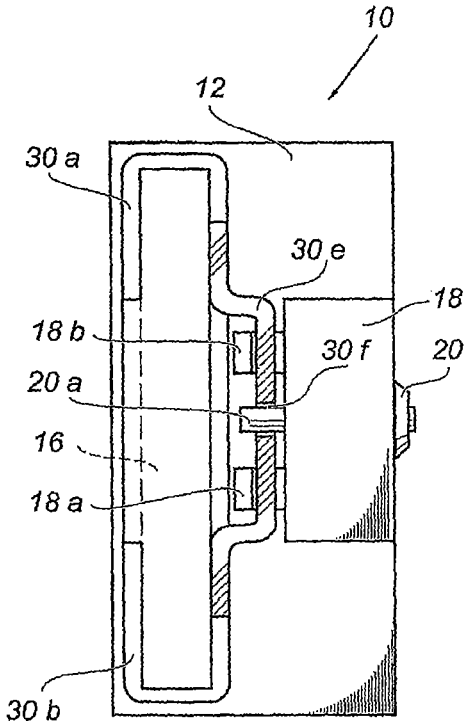
FIG. 4 is a partial cross-sectional view taken along line IV-IV of FIG. 3.

Further formed (e.g. by bending) is a tubular channel 30*g*, open along its side facing the back of the device 16 as seen in FIG. 3.

Anchoring cable 40 is provided, having a head 40*a* at one end, and a loop 40*b* at its other end by which it can be tied to an immovable object such as a table leg 42.

The use of the theft-protecting assembly 10 proceeds in the following manner.

First, the cradle 12 is affixed to a supporting surface 50 by screws 52 or by durable glue.

The jacket 30 is dressed over the protected device 16 (or vice-versa) by a sliding movement, after insertion of the headed cable side into the channel 30*g* while the other side is looped around the immovable object 42.

The thus tied protected device 16 with jacket 30 is inserted into the cavity 14 down to a position where the bridge-portion 30*e* becomes seated on the hooks 18*a* and 18*b* and the lock pin 20*a* is aligned with the opening 30*f*.

Once properly seated, the push-button lock is operated so that the locking pin 20*a* passes through the opening 30*f*. The device 16 with jacket 30 becomes inseparateable while the assembly as a whole is secured to the table leg 42 until the recharging cycle is completed (or any time thereafter).

To release the device 16, the above described operations are preformed in the reversed order.

It is an inherent drawback of the above described embodiment of the invention that it requests a specially tailored cradle to fit different models (sizes) of electronic devices.

To cure this, the second, modified embodiment of FIGS. 5-12 is hereby proposed. Similar parts and components are designated by numbers corresponding to those of the first embodiment but with the prefix "1".

There are available in the marketplace "universal" recharging stands for a variety of models, e.g. for APPLE music players. An example is shown in FIG. 5.

Figure 5:
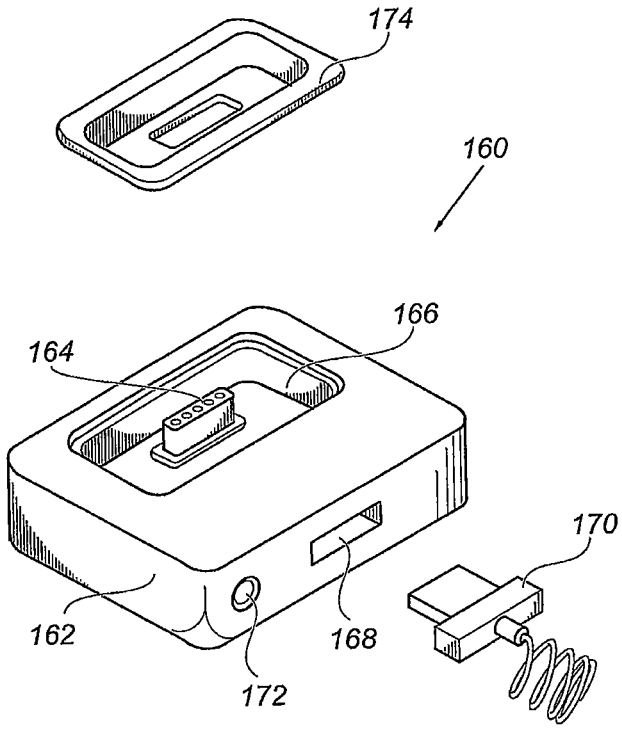
FIG. 5 shows one model of a commercially available universal recharging unit.
Figure 6:
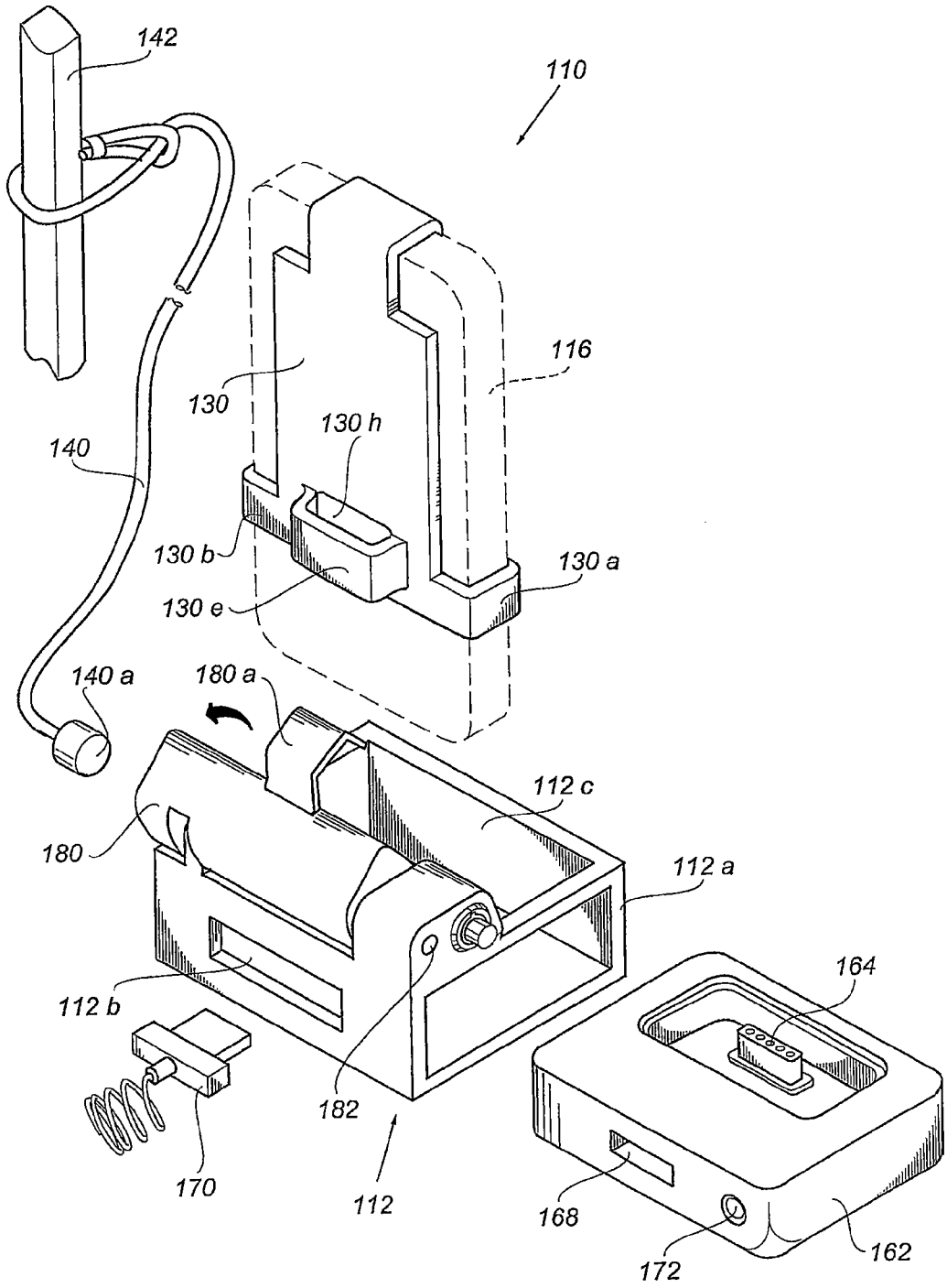
FIG. 6 is a rear perspective view of a second preferred embodiment of the present invention in a disassembled position.
Figure 7:
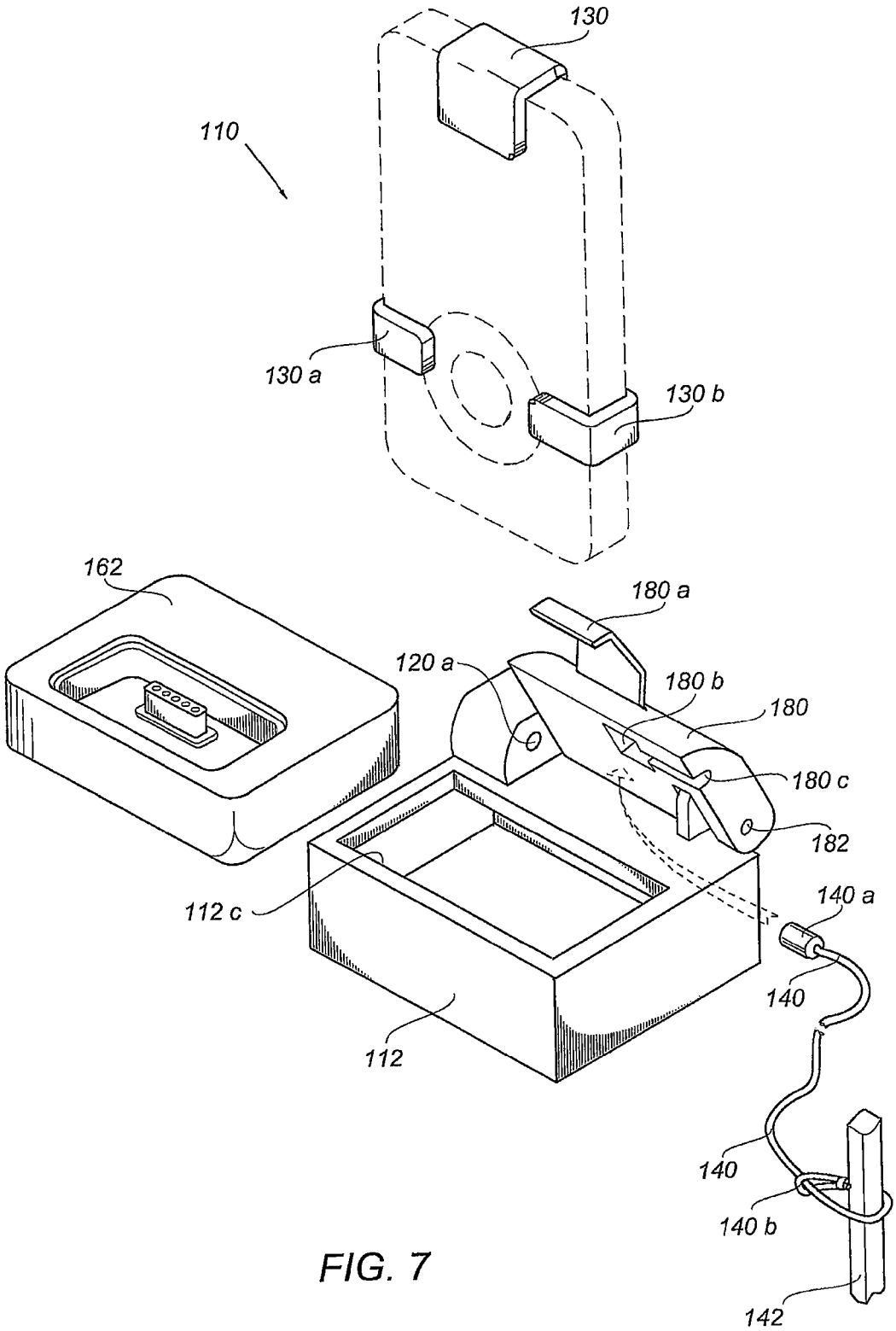
FIG. 7 is a front perspective view of the assembly of FIG. 6.
Figure 8:
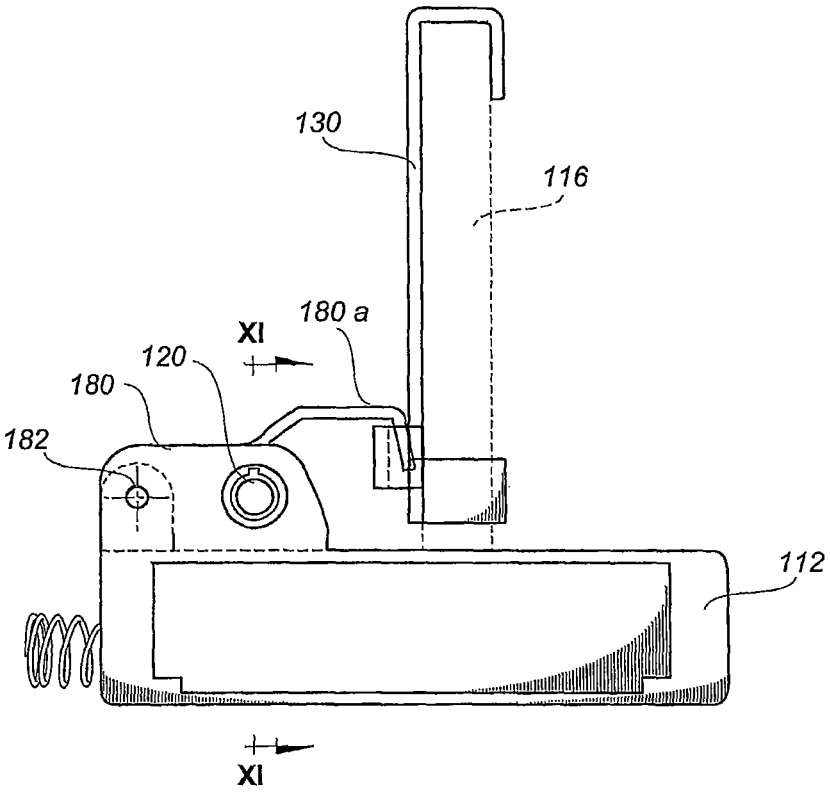
FIG. 8 is a side-view of the assembly in the locked position.

As illustrated, the stand designated 160 in FIG. 5 comprises a block-shaped base 162 containing the wiring between recharging, built-in first socket 164 located within cavity 166, and a second socket 168 into which charger plug 170 is insertable. Pilot-lamp 172 is lit upon electric connection for as long as the charging cycle is maintained.

Replaceable adaptors such as denoted 174 are usually supplied, to fit different models of music players to the same docket.

Referring to FIGS. 6-12, the protected device 116 is dressed by a jacket 130 (the opening 30*f* is, however, not required—see below), but in an up-side-down position, namely with the recharging socket facing down.

There is provided a block-shaped base 112 having a hollow 112*a* into which the stand 162 can be inserted by sliding from the side, leaving exposed the socket 168 for insertion of the plug 170 through passage 112*b*, and the top 112*c* for seating the protected device 116 along with jacket 130.

For arresting the protected device 116 against the base 112, the following arrangement is devised. A pivotable member 180 is provided, adapted to rock between an open position (best seen in FIG. 9) and a locked position (FIG. 10) about a pivot pin 182.

The member 180 is formed with a hook portion 180*a* adapted to fit into the gap 130*g* defined by the stamped-out bridge-portion 130*e* in the locked position of the assembly.

The pivotable member 180 is formed with a recess 180*b* extended by a channel 180*c* to receive therein the head 140*a* and a length of the cable 140, respectively.

The base 112 is affixed to a support by screws or glue as in the previous embodiment (cf. FIG. 3).

Figure 11:
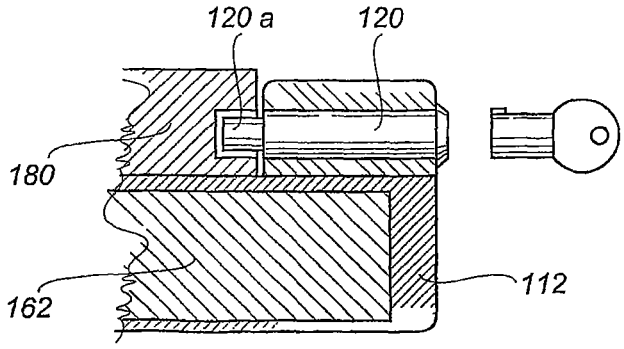
FIG. 11 is a partial cross-section taken along line XI-XI of FIG. 8.
Figure 9:
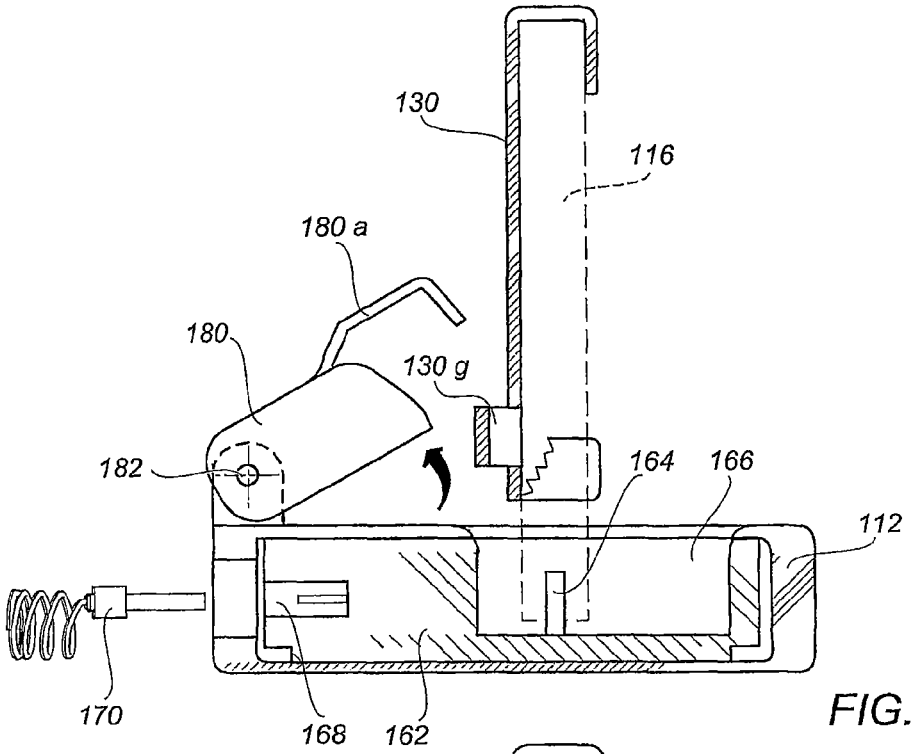
FIG. 9 is a cross-section of FIG. 8 but in the unlocked position.
Figure 10:
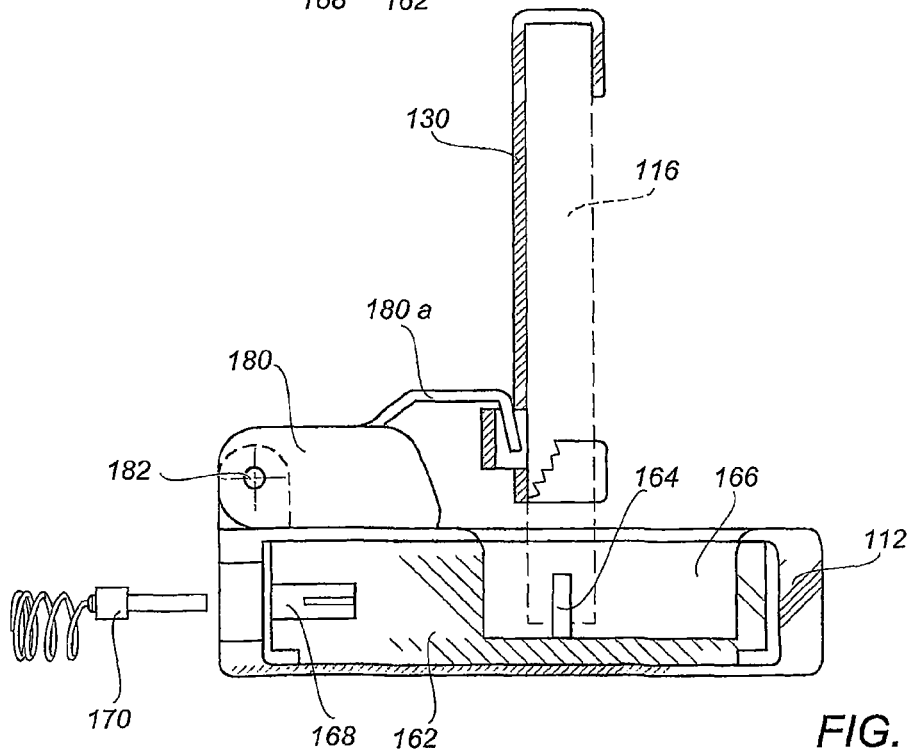
FIG. 10 is a cross-section of FIG. 8.
Figure 12:
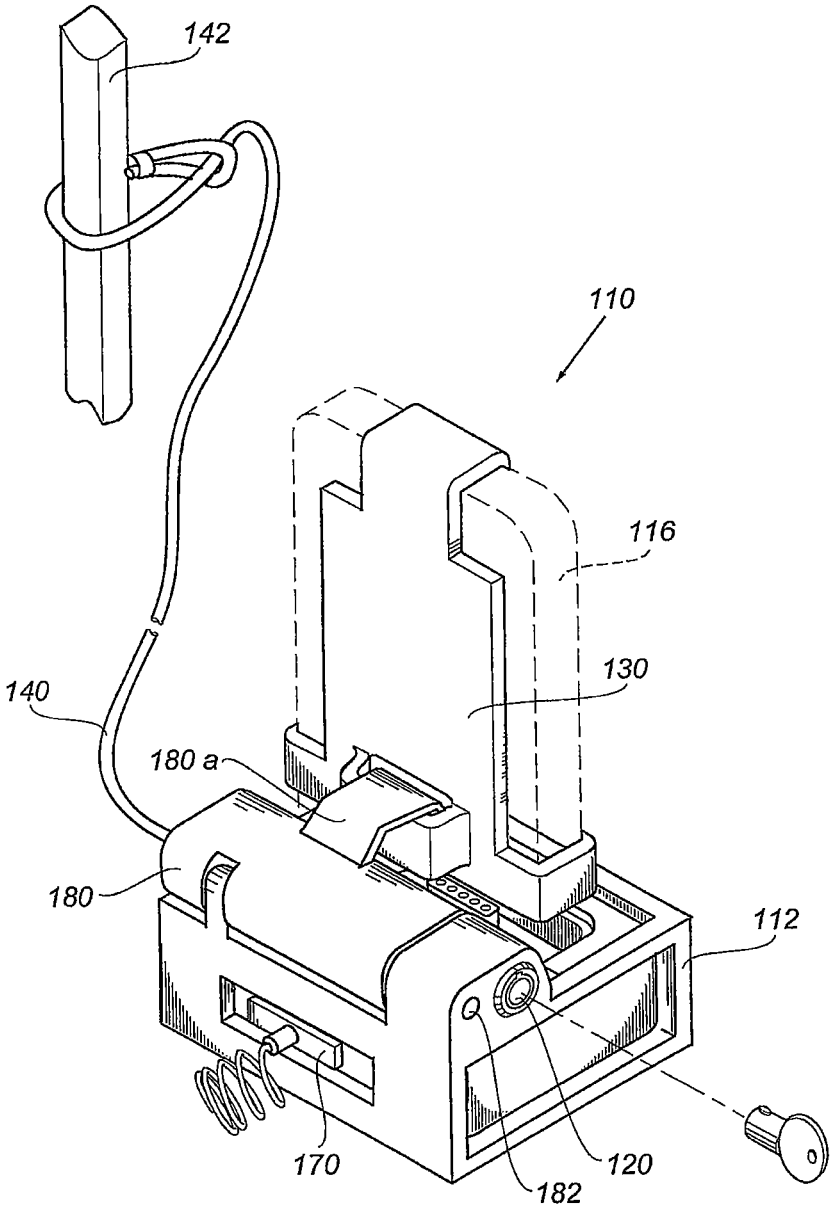
FIG. 12 is a rear perspective view in the assembled position.

A key-operated lock device 120 of the push-button type (or equivalent) is installed as best seen in FIG. 11.

The functioning of the assembly 110 as an anti-theft device (FIG. 12) would be clear to the learnt reader in view of the above description and need not be further elaborated upon.

Those skilled in the art to which this invention pertains will readily appreciate that numerous changes, variations and modifications can be devised without departing from the true spirit and scope of the invention as defined in and by the appended claims.

What is claimed is:

1. In combination, a theft-protecting assembly and charger for hand-held electronic devices having a front side panel, a bottom side with standard charging socket, a back-wall, a top and two side-walls, the combination comprising:

a jacket made of a rigid material configured to embrace the electronic device from at least the back, the top and the two side-walls so that the jacket can be dressed over the device by a sliding movement;

a lock receiving portion in the form of a bulge formed in the back-wall of the jacket defining a hollow space distanced from the back wall of the device;

a generally blocked-shaped cradle formed with a cavity configured to house a standard recharging stand comprising a built-in charging plug internally wired to an external charging socket;

a key-operated locking device comprising a pivotable member mounted to the cradle provided with a hook-like extension adapted, in one position thereof, to become inserted into said hollow space, and in another position, to move away from the hollow space, the locking device being operable to lock the pivotable member to the cradle in said one position thereof; and means for securing the cradle to an immovable object.

2. The combination as claims in claim 1 wherein the pivotable member comprises a recess configured to receive a head extended by a security cable so that in the said one position of the pivotable member the head remains trapped and the other end of the cable being adapted to be secured to said immovable object.

3. The combination as claimed in claim 2 wherein the locking device is of the push-button type.

* * * * *